US005497832A

United States Patent [19]

Stuebinger et al.

[11] Patent Number: 5,497,832

[45] Date of Patent: Mar. 12, 1996

[54] DUAL ACTION PUMPING SYSTEM

[75] Inventors: Lon A. Stuebinger, Littleton, Colo.; Kevin R. Bowlin; Carlos W. Pardo, both of Sugarland, Tex.

[73] Assignee: Texaco Inc., White Plains, N.Y.

[21] Appl. No.: 286,361

[22] Filed: Aug. 5, 1994

[51] Int. Cl.[6] ..... E21B 43/38; E21B 43/40

[52] U.S. Cl. ..... 166/369; 166/106; 417/534

[58] Field of Search ..... 166/369, 106, 166/105, 105.5; 417/535, 536, 534

[56] References Cited

U.S. PATENT DOCUMENTS

| | | | |
|---|---|---|---|
| 597,155 | 1/1898 | Temple | 417/534 |
| 959,321 | 5/1910 | Dorward | 417/534 X |
| 2,281,801 | 5/1942 | Reynolds et al. | 166/106 X |
| 2,910,002 | 10/1959 | Morgan | 166/105.5 X |
| 3,199,592 | 8/1965 | Jacob | 166/106 X |
| 4,187,912 | 2/1980 | Cramer | 166/369 |
| 4,251,191 | 2/1981 | Gass et al. | 417/111 |
| 4,295,795 | 10/1981 | Gass et al. | 417/111 |
| 5,176,216 | 1/1993 | Slater et al. | 166/105.5 |
| 5,296,153 | 3/1994 | Peachey | 210/787 |

*Primary Examiner*—Hoang C. Dang
*Attorney, Agent, or Firm*—James L. Bailey; Kenneth R. Priem; William J. Beard

[57] ABSTRACT

A system for improving the economics of production by reducing lifting costs of a producing well utilizes the upstroke of a pump to produce a fluid mixture of primarily oil with only a fraction of the produced water and the downstroke to inject the remaining produced water beneath a packer into a lower formation.

2 Claims, 5 Drawing Sheets

DUAL ACTION PUMPING SYSTEM

BACKGROUND OF THE INVENTION

1. The Field of the Invention

The present invention pertains to a method and apparatus for improving the economics of production from a producing well. In particular, the present invention utilizes the upstroke of a pumping system to bring to the surface the produced oil, and a portion of the produced water, and the downstroke to inject the remaining water into another, usually deeper, formation.

2. The Prior Art

There has long been, throughout the entire petroleum industry, an effort to improve the economics of production by reducing the pumping or "lifting" costs. One such attempt has been the method known as "gas lifting" in which a high pressure reservoir gas or inert gas is injected into the production tube to lower the specific gravity of the oil and thus increase the upward rate of flow. Examples of this may be found in U.S. Pat. Nos. 4,251,191 and 4,295,795. However, normally large volumes of water are produced, along with the oil, and there are associated costs in both the lifting and the subsequent handling of this produced water after it has arrived at the surface. To date the efforts to reduce the costs associated with water production have primarily been directed towards sealing off water producing layers, either with mechanical devices positioned downhole at the water producing layer or by means of chemicals or cement injected into the water producing layer.

The present invention takes a different approach which is to separate the produced oil and water downhole in an annulus formed between the casing and production tubing, lift the oil and only a portion of the water, and inject the remaining water downhole instead of trying to shut the water off. One significant benefit of the present invention is a substantial reduction in the lease costs which are directly associated with the amount of fluid lifted from a producing well. A reduction in the volume of fluid lifted for the well also results in lowering horsepower requirements, since only a fraction of the total produced fluid, namely the produced oil and only a portion of the produced water, is lifted to the surface. Also, injection power costs, water treating costs, spill containment and cleanup costs, and some maintenance costs can be expected to be significantly reduced through use of the present invention.

A somewhat similar approach to the problem of produced water is detailed in U.S. Pat. No. 5,176,216. However, this patent is addressed to a significantly different problem in that it concerns gas production. The gas, by virtue of its low specific gravity, does not require pumping to the surface for production, as is the case for the heavier petroleum products. Thus this patent is concerned with injecting produced water below a packer to keep the gas producing strata above the level of the produced water.

The subject invention also has applications with respect to waterflooding deeper zones with excess water produced from shallower zones. In typical waterflood applications, water and oil are produced by conventional methods to a battery where it is separated and temporarily stored. Then the water is pumped through a facility into an injection well. The injection wells are either strategically drilled new wells or existing wells which are converted to this purpose. In particular situations, the desired placement of injection wells is not always possible because of limiting economic factors, such as the location and number of idle wells, injection facility size, reservoir size, pipeline location, etc. The present invention may allow small scale floods or pattern reconfiguration, due to the dual utility of a single wellbore, without the attendant high costs of surface facilities.

SUMMARY OF THE INVENTION

The present invention concerns a method and apparatus to use the upstroke of a dual action pumping system to lift to the surface substantially all of the produced oil and only a fraction of the produced water and the downstroke to inject the remaining portion of the produced water into a lower strata in the same wellbore. An important feature of this system is that it takes advantage of natural gravity segregation of oil and water within the wellbore. The invention consists of at least one pump assembly with modified valve arrangements utilizing two vertically spaced fluid intake ports instead of a single intake port. The vertical separation of the two intake ports determines the chances of injecting oil into the deeper interval with the excess water. The resulting combination will pump the produced oil, and a portion of the produced water, to the surface from an upper intake port while pumping the remaining water into an injection or disposal zone from a lower intake port, utilizing the casing/tubing annulus as an oil/water separator. The present invention will better utilize the energy from the up and down motion of the pumping unit. The present invention allows water injection into deeper zones of currently producing wells at relatively low cost. Further benefits include the reduction in water handling at the surface and the costs associated with these processes.

BRIEF DESCRIPTION OF THE DRAWINGS

The present invention will now be described, by way of example, with reference to the accompanying drawings in which.

DETAILED DESCRIPTION OF THE PRESENT INVENTION

Figure 1:
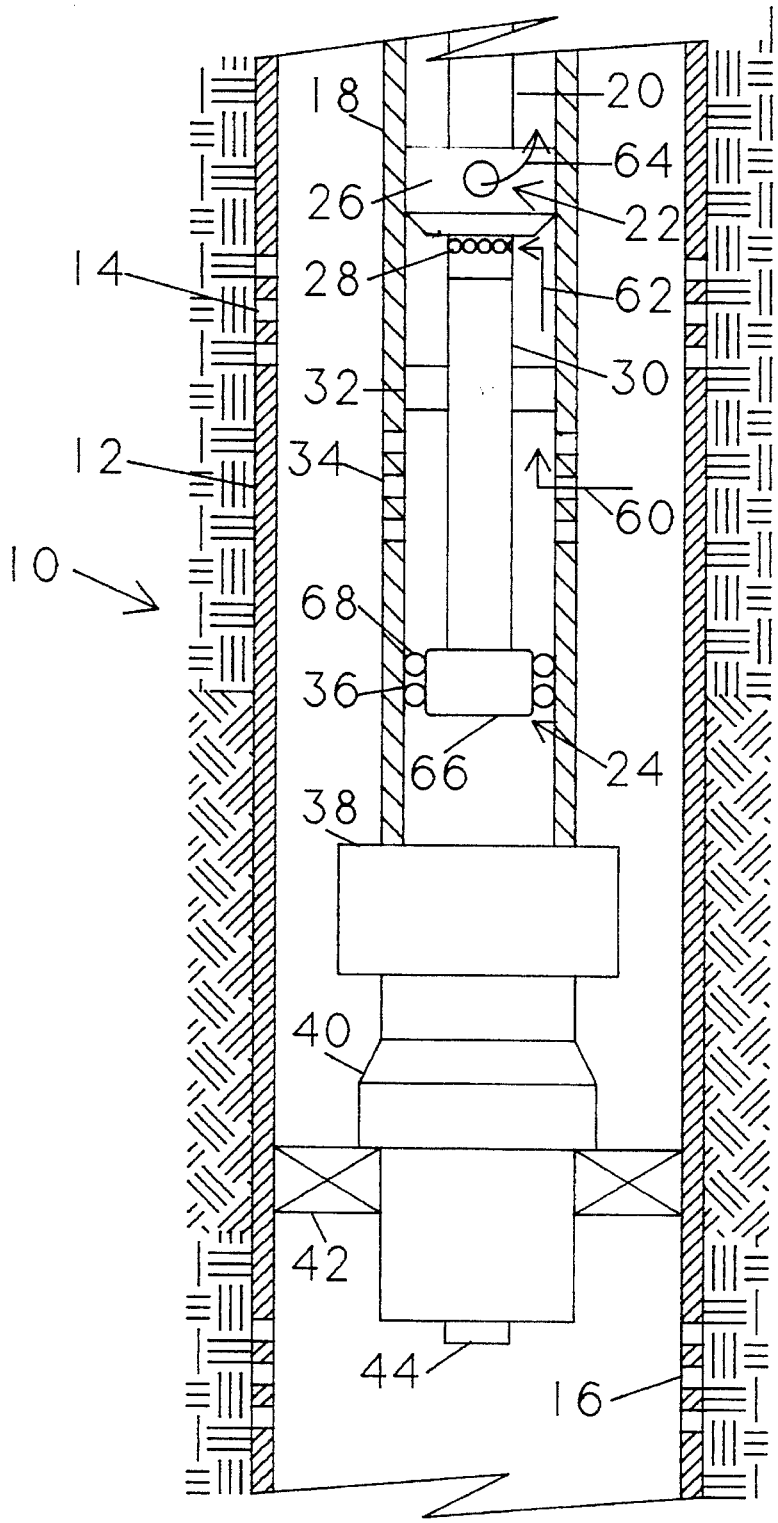
FIG. 1 is a schematic side elevation, partially in section, of-a dual pump embodiment of the present invention.
Figure 3:
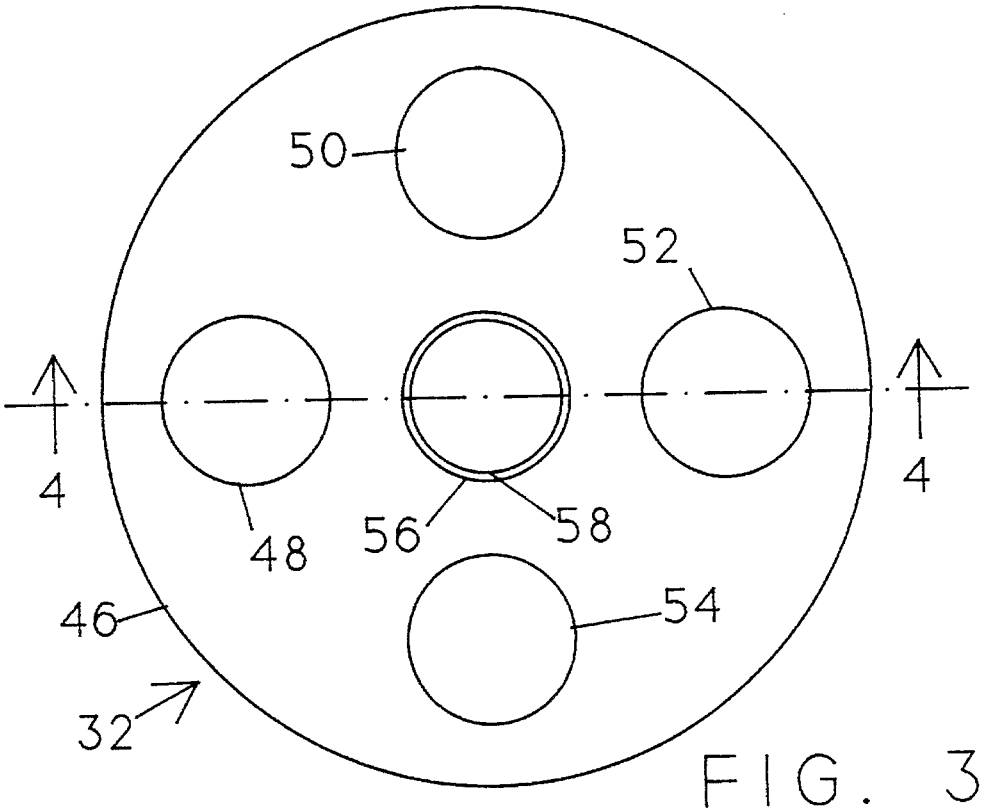
FIG. 3 is a top plan view of a modified standing valve according to the present invention.
Figure 4:
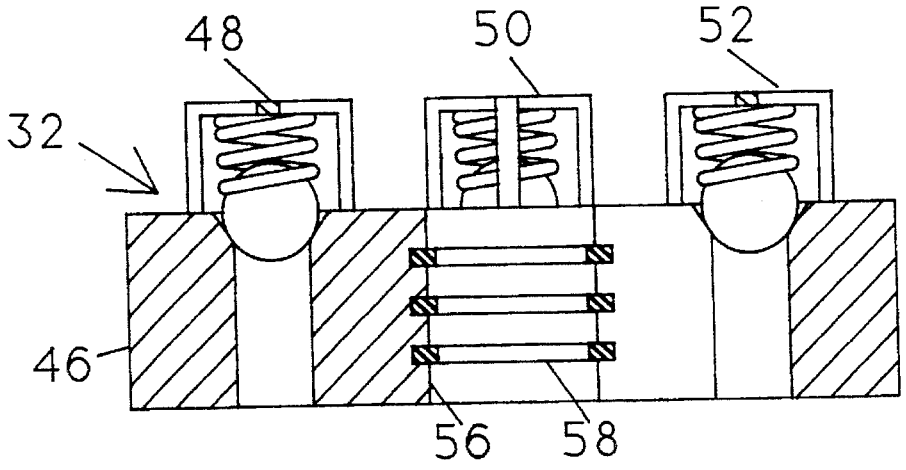
FIG. 4 is a vertical section through the modified standing valve taken along line 4—4 of FIG. 3.
Figure 6:
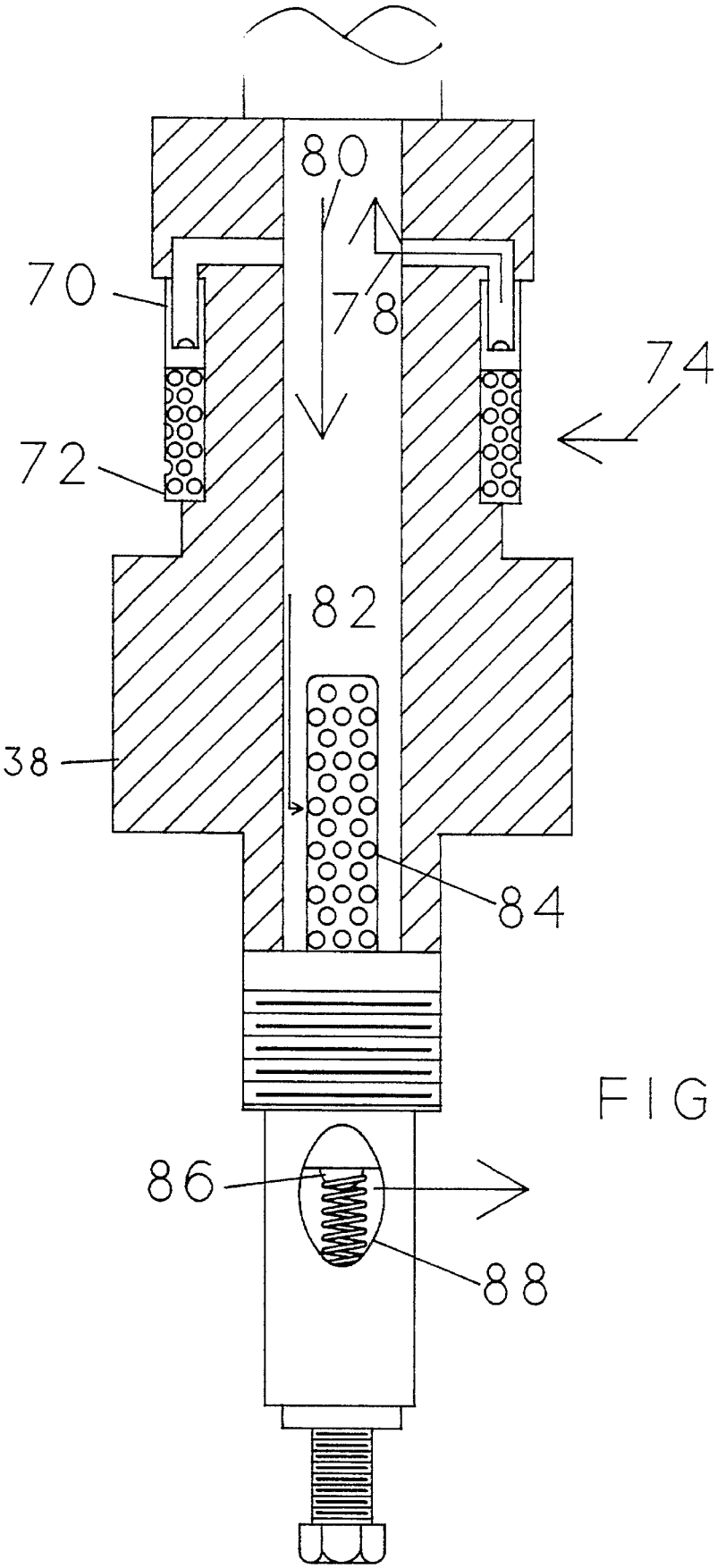
FIG. 6 is a schematic vertical section, partially in section, through a down hole injection assembly.

The dual action pumping system embodiment, as shown in FIG. 1, is basically two modified downhole plunger pumps coupled together by a polished rod. The well 10 has a casing string 12 with at least producing perforations 14 and injection perforations 16 vertically spaced therealong. A tubing string 18 extends downhole within the casing with a sucker rod string 20 therein supporting an upper pump assembly 22 and a lower pump assembly 24. The upper pump assembly 22 is a conventional plunger pump with a perforated hollow sucker rod 28 attached to the bottom of the plunger 26. A polished rod 30 is connected between the hollow sucker rod 28 and the lower pump assembly 24. The polished rod 30 passes through a modified standing valve 32 (the details of which are shown in FIGS. 3 and 4) which is positioned in the tubing string 18 between the upper and lower pump assemblies 22 and 24, respectively. A perforated tubing nipple 34 is positioned in the tubing string 18 below the modified standing valve 32. The lower pump assembly 24 has a modified tubing plunger pump 36 with a plugged plunger. A downhole injection assembly 38, which allows water entry and is shown in detail in FIG. 6, optional on/off tool 40, packer 42, and check valve 44 complete the assembly.

Turning now to FIGS. 3 and 4, which show the details of the modified standing valve 32, the valve 32 is basically a steel plate 46 fixed inside a tubing segment (see FIG. 1) and is provided with a plurality of ball and seat assemblies 48, 50, 52, 54 positioned around an axial opening 56 for the polished rod 30 to pass through. The ball and seat assemblies have here been shown as spring loaded check valves but other similar arrangements, such as simple gravity actuated ball assemblies, could also be used. The axial opening 56 is provided with a plurality of annular seals 58 to seal against the polished rod 30.

In operation, the annulus between the casing 12 and the tubing string 18, and above the packer 42, will act as a produced fluid collector and, by gravity, an oil and water separator. The perforated tubing nipple 34, in the tubing string 18 just below the modified seating valve 32, allows fluid entry into the intake of the upper pump assembly 22. Although the tubing plunger pump 26 has been modified, it will perform like a conventional pump. In the pumping cycle, water and oil are drawn through the upper pump assembly 22, as noted by arrows 60, 62 and 64.

The lower plunger pump 36, which is connected to the lower end of polished rod 30, has a plunger 66 with annular sealing means 68 which enables it to act as a piston. The downhole injection assembly 38, shown in detail in FIG. 6 , provides inlet valve means 70 which reverses the action of the lower plunger pump 36. This allows the intake of the downhole injection assembly 38 to be positioned at the lower extreme of the wellbore, in the produced water below the oil-water interface. Water is drawn into the lower plunger pump 24 through inlet strainer means 72 on the upstroke of the pump, as noted by arrows 74, 78. At the start of the downstroke, the inlet valve means 70 will close and the plunger 66 will push the water, in the direction of arrows 80, 82, through discharge strainer 84 and standing valve and adjustable back pressure valve assembly 86 and port 88 to beneath a standard production packer 42 and into the injection interval. The packer 42 is preferably positioned just above the injection interval.

Although this first embodiment uses two pumps for added flexibility in sizing, the same thing could be accomplished with modifications to the valve means on a single pump and plunger combination as discussed below in the second embodiment.

Figure 2:
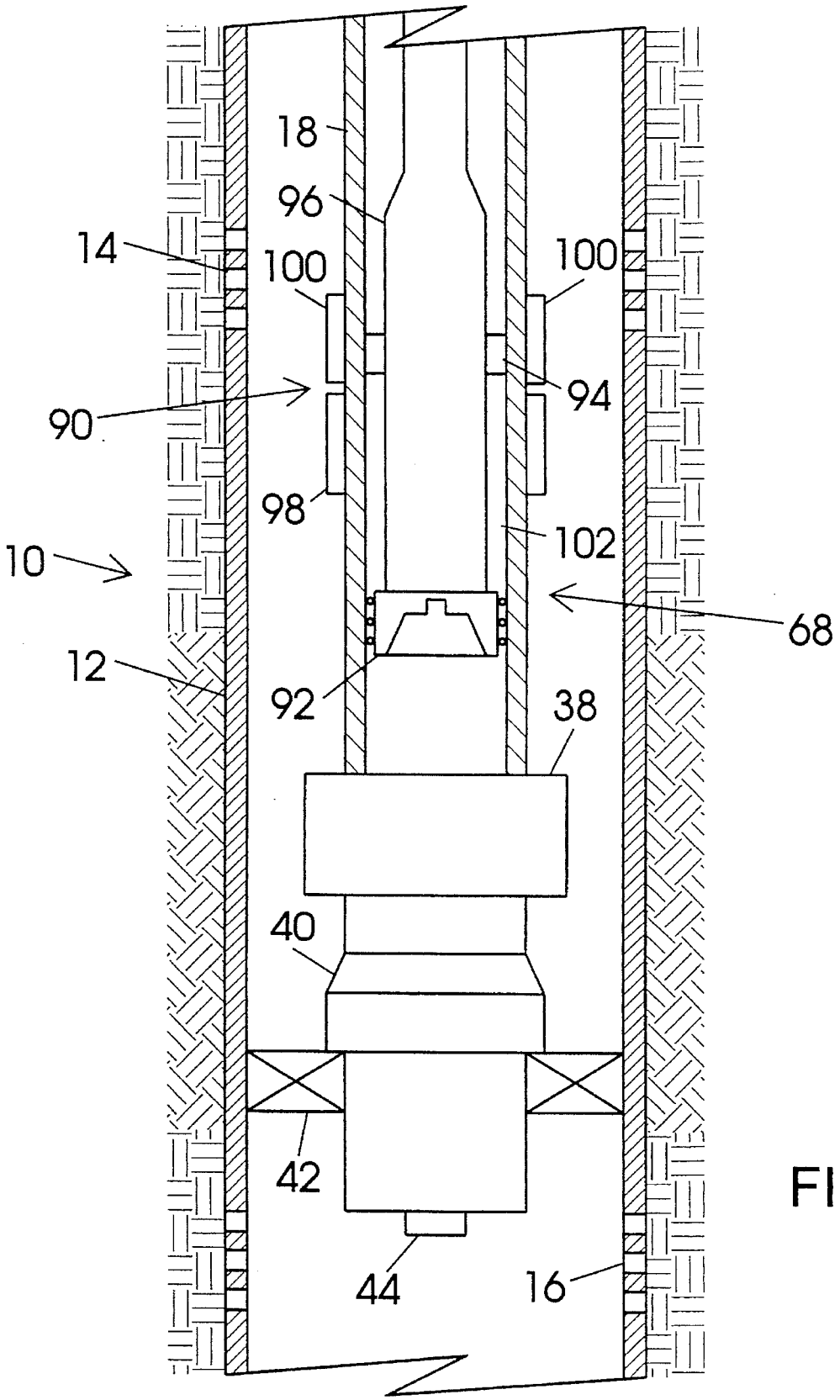
FIG. 2 is a schematic side elevation, partially in section, of a single pump embodiment of the present invention.
Figure 5:
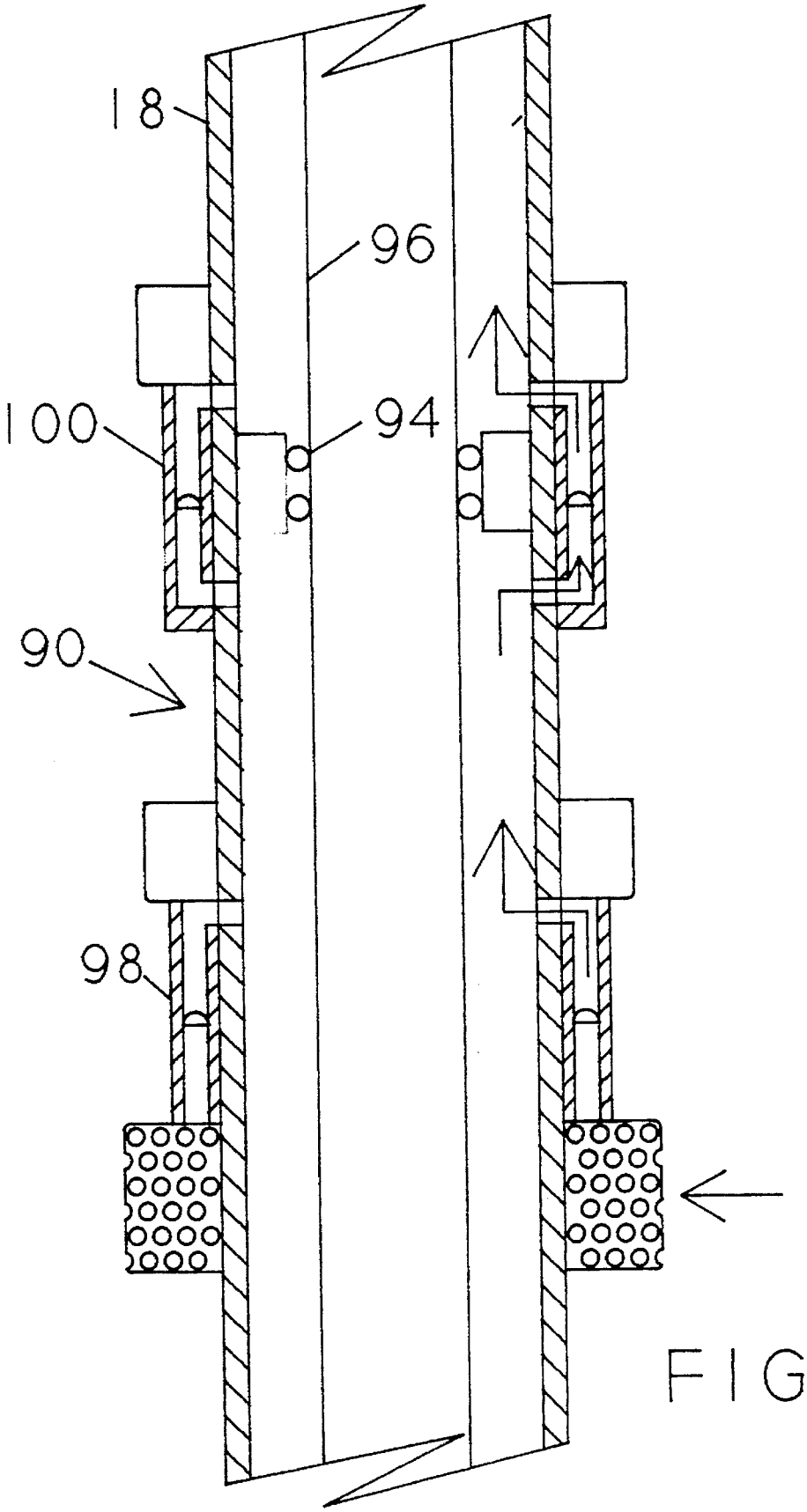
FIG. 5 is a schematic vertical section, partially in section, through a top valve tool.

The single pump system, shown in FIG. 2, accomplishes substantially the same results as the two pump embodiment with a single pump assembly. The downhole injection assembly 38 acts in exactly the same manner as in the dual pumping system described above. A top valve tool 90, shown in detail in FIG. 5, allows pumping action above the plugged plunger 92. The top valve tool 90 is coupled into the tubing string 18 and provides a seal 94 for the polish rod 96. The top valve tool 90 has a set of lower valve means 98 and a set of upper valve means 100.

On the downstroke, oil and water enter the lower set of valves 98 and fill the annulus 102 between the pump barrel and polished rod. As the upstroke begins, the lower set of valves 98 close and the upper valves 100 open. Oil, and some of the produced water, then passes through the upper valve means 100, around the seal 94 and into the tubing string 18. Then, as the upward stroke of the cycle is complete, the upper valve means 100 close and the lower valve means 98 open to allow the pump to fill.

The pumping volume is a function of the polished rod diameter, stroke length, plunger diameter, and pump barrel size. The single pump system is less expensive than the dual action pumping system, although the sizing flexibility is somewhat limited.

The basic concept of dual inlets and utilizing the wellbore as a separator can be expanded to cover a wide variety of applications. This producing technique could be coupled with the downhole water drainage concept, in which oil and water are produced simultaneously from above and below an oil/water interface, respectively, to reduce water coning. Artificial barriers (gels) could also be positioned in an interval allowing injection of produced water back into the same interval with the present invention. Other mechanical configurations or modifications, utilizing the basic described concept, will probably be developed to achieve the same results and to refine the concept.

An important feature of this system is that it takes advantage of gravity segregation of oil and water within the wellbore. This phenomenon has been verified by observations with downhole video cameras run in dynamic pumping conditions. It is noted that visualization of downhole conditions, via a video camera in a well, suggest that the wellbore is a very efficient separator and that little or no emulsification of the produced oil and water occurs prior to entering the pump chamber. This condition may not exist in all circumstances, but provides some assurance that the injection fluids are substantially oil free. Not only should this condition exist, but, the oil cut, producing rates, fluid levels and other parameters must be known to properly design the subject system. In a high water cut well, the lower pump should be sized to handle most of the produced fluids. For example, a well with a 10% oil cut could be sized to inject 80% of the water and produce the remaining 20%. Since the casing is acting as a separator, the oil and a small portion of the water are skimmed off and produced to the surface by the upper pump. The remaining water would be injected below the packer. The injection rates and pressures can be calculated from dynamometer runs for monitoring purposes. Also the injection interval could be chemically treated by pumping the treatment chemicals down the casing annulus, with the tubing shut-in. The oil collected in the annulus should be circulated out of the well prior to any chemical treatment of the well.

The concept described above will potentially benefit many production operations by dramatically reducing the lifting cost for high water cut wells. This could extend the life of mature fields, improve recovery factors, add reserves and, in some cases, increase production.

The present invention may be subject to many modifications and changes, which will become apparent to one skilled in the art, without departing from the spirit or essential characteristics thereof. The above described embodiments are to be considered in all respects as being illustrative and not restrictive of the scope of the invention as defined by the appended claims.

We claim:

1. A method to improve the economics of production from a producing oil field by reducing lifting costs, comprising the steps of:

providing a casing string downhole in a producing well and having upper producing perforations and lower injection perforations;

providing a tubing string extending down through said casing forming an annulus therebetween;

providing downhole pumping means having a single piston and connected by a rod string extending through said tubing string toward the surface of the earth and moveable upwardly and downwardly within said tubing string, said pumping means having upper inlet ports for oil and lower inlet ports for water;

providing valve means in said pumping means for selectively inputting fluid from said annulus through said upper inlet ports on a downstroke of said rod string and through said lower ports on an upstroke of said rod string;

providing packer means between said casing string and said tubing string and separating said annulus between said producing perforations and said injection perforations;

allowing produced fluid comprising oil and water to collect in said annulus above said packer and separate into its oil and water components by gravity therein;

providing at the surface a fluid mixture of primarily oil and a fraction of the produced water on an upstroke of said rod string; and injecting the produced water input into said lower inlet ports into said injection perforations below said packer means on a downstroke of said rod string.

2. An apparatus for improving the economics of production from a producing oil field by reducing lifting costs, comprising;

a casing string extending downhole in a well and having therein at least vertically spaced production and injection perforations;

a tubing string extending downhole within said casing string forming an annulus therebetween;

pumping means carried by said tubing string and located downhole and having a single piston capable of moving upwardly and downwardly and upper inlet ports and lower inlet ports vertically spaced apart;

valve means comprising part of said pumping means for selectively allowing fluid in said annulus to enter said upper inlet ports on a downstroke of said piston and said lower inlet ports on an upstroke of said piston; and packer means closing the lower end of said annulus whereby produced oil and water collect in said annulus, separate by gravity and on the upstroke of said piston primarily oil and only a fraction of the produced water are pumped to the surface and on the downstroke of said piston the separated produced water is injected below said packer means.

* * * * *